US010113717B2

(12) United States Patent
Li

(10) Patent No.: US 10,113,717 B2
(45) Date of Patent: Oct. 30, 2018

(54) LOCKING STRUCTURE FOR LED LAMP

(71) Applicant: Feng Li, Guangdong (CN)

(72) Inventor: Feng Li, Guangdong (CN)

( * ) Notice: Subject to any disclaimer, the term of this patent is extended or adjusted under 35 U.S.C. 154(b) by 0 days.

(21) Appl. No.: 15/310,766

(22) PCT Filed: May 26, 2015

(86) PCT No.: PCT/CN2015/079756

§ 371 (c)(1),
(2) Date: Nov. 13, 2016

(87) PCT Pub. No.: WO2016/183860

PCT Pub. Date: Nov. 24, 2016

(65) Prior Publication Data

US 2018/0119930 A1 May 3, 2018

(30) Foreign Application Priority Data

May 19, 2015 (CN) ..... 2015 1 0257567

(51) Int. Cl.

| | |
|---|---|
| ***F21V 19/00*** | (2006.01) |
| ***F21V 17/10*** | (2006.01) |
| ***F21V 15/01*** | (2006.01) |
| ***F21V 21/08*** | (2006.01) |

(52) U.S. Cl.

CPC ..... *F21V 19/0015* (2013.01); *F21V 15/01* (2013.01); *F21V 17/10* (2013.01); *F21V 19/00* (2013.01); *F21V 21/0808* (2013.01)

(58) Field of Classification Search

CPC .. F21V 19/0015; F21V 15/01; F21V 21/0808; F21V 17/10; F21V 17/104

See application file for complete search history.

(56) References Cited

U.S. PATENT DOCUMENTS

| | | | | |
|---|---|---|---|---|
| 9,625,122 | B2 * | 4/2017 | Andrisin | F21V 13/04 |
| 9,873,620 | B2 * | 1/2018 | Hajee | C02F 1/325 |
| 2015/0285449 | A1 * | 10/2015 | Hajee | F21V 33/0056 362/183 |
| 2016/0109104 | A1 * | 4/2016 | Liu | F21V 23/02 362/294 |

FOREIGN PATENT DOCUMENTS

| | | | | |
|---|---|---|---|---|
| CN | 203628457 | * | 6/2014 | F21V 17/12 |

* cited by examiner

*Primary Examiner* — Donald Raleigh

(57) ABSTRACT

A locking structure for an LED lamp contains: a casing, a substrate, at least one locking slot defined between the substrate and the casing, and at least one fixing element configured to fix the casing and the substrate. The substrate includes a trench formed therein, and a profile of the trench corresponds to the casing so that the trench accommodates and retains with the casing. The at least one locking slot and the at least one fixing element are defined between a peripheral fence of the trench and a peripheral wall of the casing, and the at least one fixing element is inserted into the at least one locking slot so as to fix the casing and the substrate.

15 Claims, 3 Drawing Sheets

LOCKING STRUCTURE FOR LED LAMP

FIELD OF THE INVENTION

The present invention relates to an LED lamp, and more particularly to a locking structure which fixes a casing and a substrate of the LED lamp together.

BACKGROUND OF THE INVENTION

A conventional locking structure for a light-emitting diode (LED) lamp is capable of packaging and locking a casing and a substrate of the LED lamp together.

A heat dissipation will influence using life of the LED lamp, and locking structure of the casing and the substrate of the LED lamp determines heat dissipation capacity of the LED lamp.

The casing and the substrate are aligned with each other in a packaging process and are fixed together by way of a locking structure or a fixing structure, such as screws mating with threaded holes. However, such a fixing manner is complicated.

The present invention has arisen to mitigate and/or obviate the afore-described disadvantages.

SUMMARY OF THE INVENTION

The primary objective of the present invention is to provide a locking structure which fixes a casing and a substrate of an LED lamp securely and easily.

To obtain above-mentioned objective, a locking structure for an LED lamp provided by the present invention contains: a casing, a substrate, at least one locking slot defined between the substrate and the casing, and at least one fixing element configured to fix the casing and the substrate.

The substrate includes a trench formed therein, and a profile of the trench corresponds to the casing so that the trench accommodates and retains with the casing.

The at least one locking slot and the at least one fixing element are defined between a peripheral fence of the trench and a peripheral wall of the casing, and the at least one fixing element is inserted into the at least one locking slot so as to fix the casing and the substrate.

Preferably, the substrate includes the trench formed in a central portion thereof, and the trench has a contacting face arranged on a bottom thereof and the peripheral fence surrounding an inner wall of the trench, wherein a profile of the contacting face corresponds to the casing, and a depth of the trench is equal to a thickness of the casing.

Preferably, the casing includes a bottom surface, a side surface, and a top surface, wherein when the casing is accommodated in the trench of the substrate, the bottom surface of the casing contacts with the contacting face of the trench, the side surface of the casing abuts against the peripheral fence of the trench, and the top surface of the casing flushes with a top of the substrate.

Preferably, a slit is defined between the side surface of the casing and the peripheral fence of the trench of the substrate, and the at least one locking slot is formed on two sides of the slit and accommodates the at least one fixing element.

In another embodiment, a cross section of each of the at least one locking slot is circular, and a cross section of each of the at least one fixing element is a circular so that said each fixing element mates with said each locking slot.

In another embodiment, a cross section of each of the at least one locking slot is rectangular, and a cross section of each of the at least one fixing element is a rectangular so that said each fixing element mates with said each locking slot.

In another embodiment, a cross section of each of the at least one locking slot is triangular, and a cross section of each of the at least one fixing element is a triangular so that said each fixing element mates with said each locking slot.

In another embodiment, the substrate is in a rectangle shape, the trench of the substrate and the casing are rectangular, and said each locking slot has a through orifice communicating with the substrate.

In another embodiment, said each fixing element is a column so as to insert through the through orifice and to retain with said each locking slot.

In another embodiment, said each fixing element is epoxy resin fed into said each locking slot so that the casing and the substrate are adhered together, after solidifying the epoxy resin.

In another embodiment, the substrate is in a circle shape, the trench of the substrate and the casing are circular, at least one inlet is formed on the casing perpendicular to the at least one locking slot.

Preferably, each of the at least one fixing element is epoxy resin fed into the at least one locking slot from each of the at least one inlet so that the casing and the substrate are adhered together, after solidifying the epoxy resin.

DETAILED DESCRIPTION OF THE PREFERRED EMBODIMENTS

Figure 1:
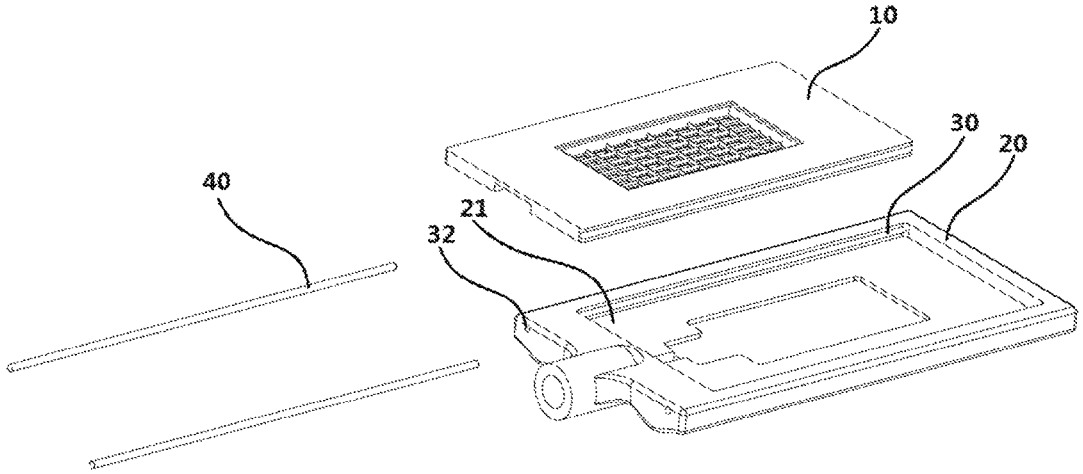
FIG. 1 is a perspective view showing the exploded components of a locking structure for an LED lamp according to a first embodiment of the present invention.
Figure 2:
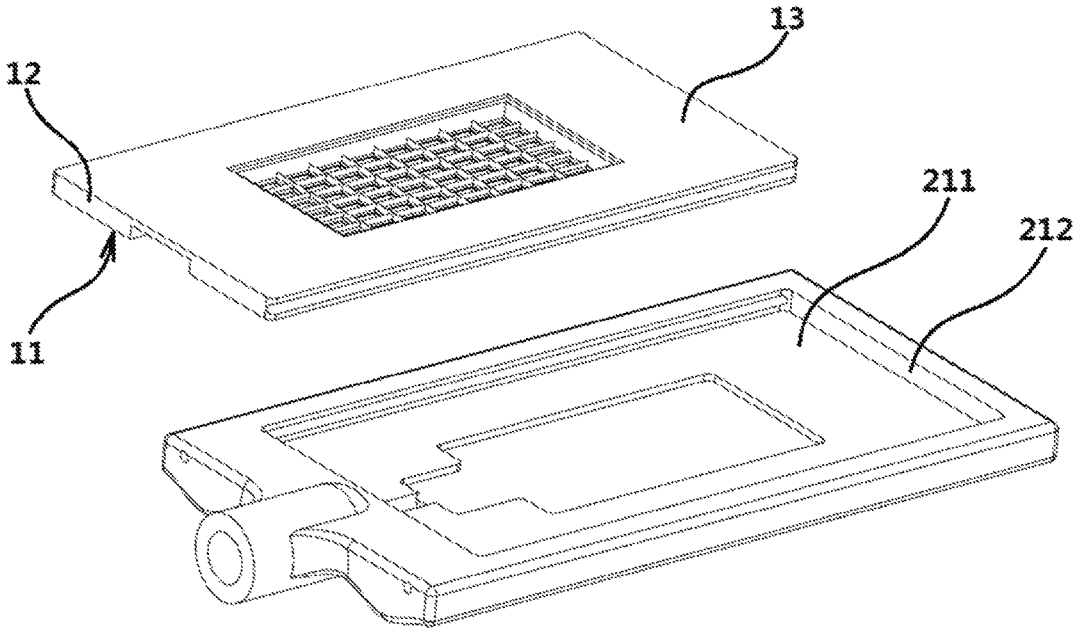
FIG. 2 is another perspective view showing the exploded components of the locking structure for the LED lamp according to the first embodiment of the present invention.

With reference to FIGS. 1 and 2, a locking structure for a light-emitting diode (LED) lamp according to a first embodiment of the present invention comprises: a casing 10 and a substrate 20, wherein two locking slots 30 are defined between the substrate 20 and the casing 10, and two fixing elements 40 are configured to fix the casing 10 and the substrate 20. As shown in FIG. 1, the substrate 20 includes a trench 21 formed in a central portion thereof, and a profile of the trench 21 corresponds to the casing 10 so that the trench 21 accommodates and retains with the casing 10.

The trench 21 has a contacting face 211 arranged on a bottom thereof and a peripheral fence 212 surrounding an inner wall of the trench 21, wherein a profile of the contacting face 211 corresponds to the casing 10, and a depth of the trench 21 is equal to a thickness of the casing 10.

The two locking slots 30 and the two fixing elements 40 are defined between the peripheral fence 212 of the trench 21 of the substrate 20 and a peripheral wall of the casing 10, wherein the two fixing elements 40 are inserted into the two locking slots 30, respectively, so as to fix the casing 10 and the substrate 20.

The casing 10 includes a bottom surface 11, a side surface 12, and a top surface 13, wherein when the casing 10 is accommodated in the trench 21 of the substrate 20, the bottom surface 11 of the casing 10 contacts with the contacting face 211 of the trench 21, the side surface 12 of the casing 10 abuts against the peripheral fence 212 of the trench 21, and the top surface 13 of the casing 10 flushes with a top of the substrate 20.

Preferably, a slit is defined between the side surface 12 of the casing 10 and the peripheral fence 212 of the trench 21 of the substrate 20, and the two locking slots 30 are formed on two sides of the slit and accommodate the two fixing elements 40, individually.

The substrate 20 is in a rectangle shape, the trench 21 of the substrate 20 and the casing 10 are rectangular, and a cross section of each of the two locking slots 30 is circular. Furthermore, each of the two fixing elements 40 is a circular column so as to retain with said each locking slot 30, and said each locking slot 30 has a through orifice 32 communicating with the substrate 20, such that said each fixing element 40 inserts through the through orifice 32 so as to retain with said each locking slot 30, thus fixing the casing 10 and the substrate 20 together.

Figure 3:
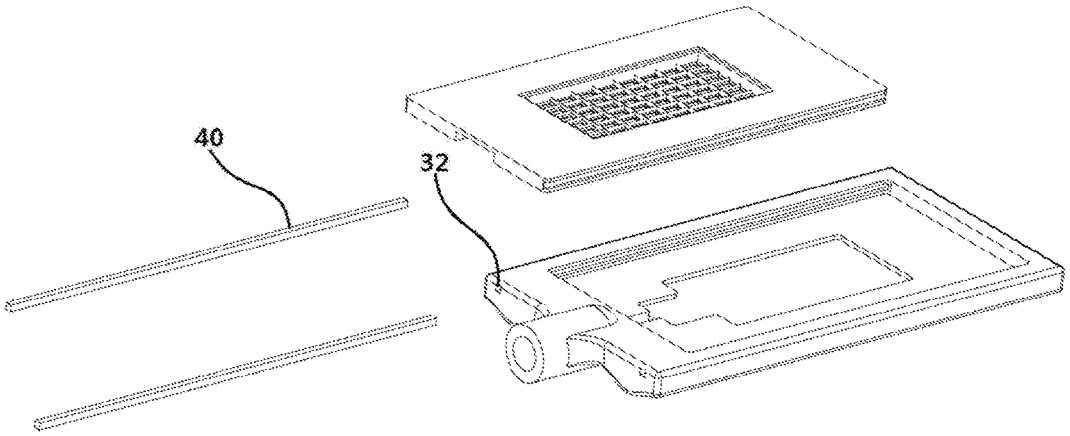
FIG. 3 is a perspective view showing the exploded components of a locking structure for an LED lamp according to a second embodiment of the present invention.

As shown in FIG. 3, in a second embodiment, a profile of a cross section of each of two locking slots 30 is rectangular, and each of two fixing elements 40 is a rectangular column so as to retain with said each locking slot 30.

Figure 4:
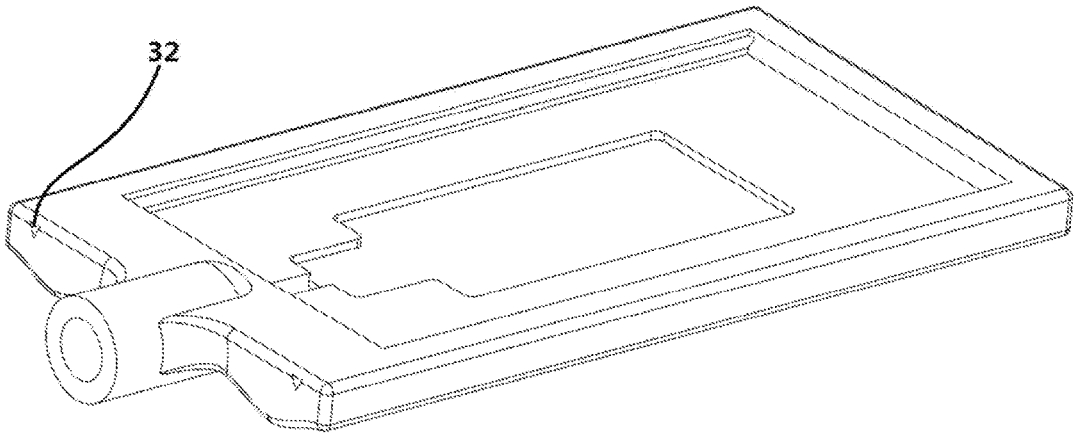
FIG. 4 is a perspective view showing the assembly of a part of a locking structure for an LED lamp according to a third embodiment of the present invention.

As shown in FIG. 4, in a third embodiment, a profile of a cross section of each of two locking slots 30 is triangular, and each of two fixing elements 40 is epoxy resin fed into said each locking slot 30, thus adhering the casing 10 and the substrate 20 together.

Preferably, each of two through orifices 32 are formed on one end of the substrate 20 adjacent to and perpendicular to said each locking slot 30, such that the epoxy resin is fed into said each locking slot 30 from said each through orifice 31, and the casing 10 and the substrate 20 are adhered together, after solidifying the epoxy resin.

Figure 5:
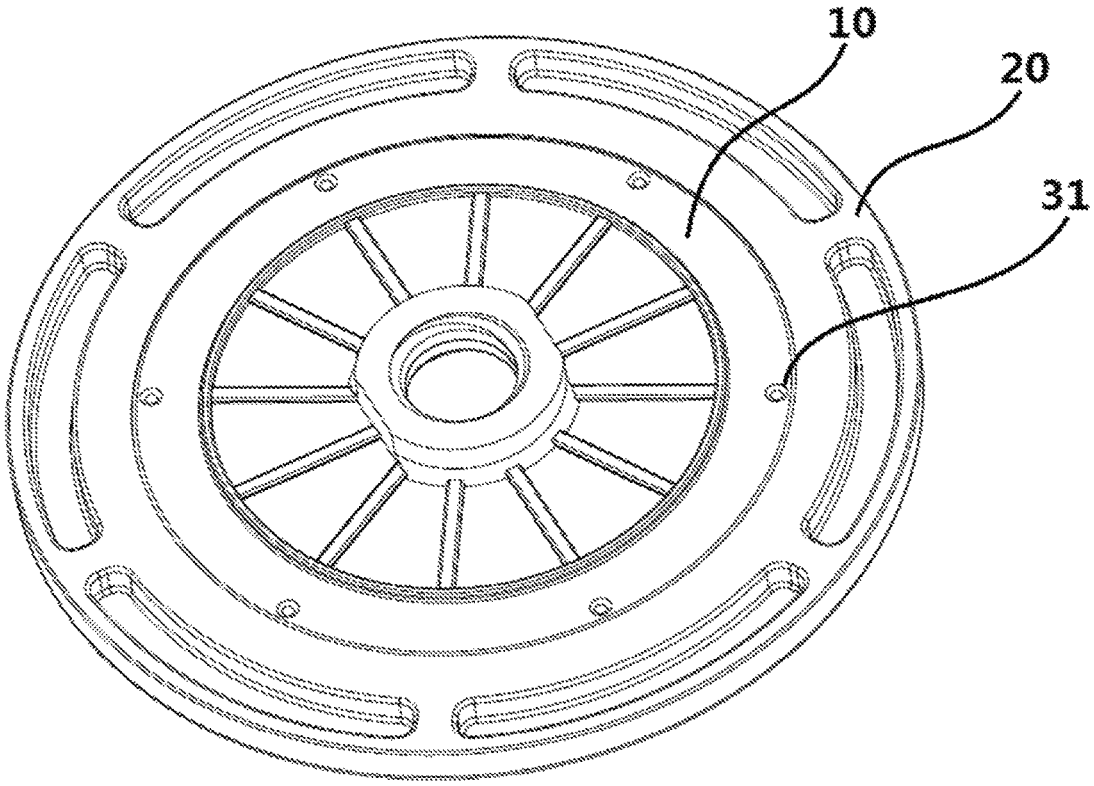
FIG. 5 is a perspective view showing the assembly of a locking structure for an LED lamp according to a fourth embodiment of the present invention.

As illustrated in FIG. 5, in a fourth embodiment, the substrate 20 is in a circle shape, the trench 21 of the substrate 20 and the casing 10 are circular, and a locking slot defined between the casing 10 and the substrate 20 is circular.

Each of at least one fixing element is epoxy resin fed into each of multiple inlets 31 perpendicular to and communicating with the locking slot, such that the epoxy resin is fed into the locking slot from said each inlet 31, and the casing 10 and the substrate 20 are adhered together, after solidifying the epoxy resin.

Thereby, the casing and the substrate are connected securely and easily by using said each fixing element, such as the circular column, the rectangular column, or the epoxy resin.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A locking structure for an LED lamp comprising: a casing, a substrate, at least one locking slot defined between the substrate and the casing, and at least one fixing element configured to fix the casing and the substrate;

wherein the substrate includes a trench formed therein, and a profile of the trench corresponds to the casing so that the trench accommodates and retains with the casing;

wherein the at least one locking slot and the at least one fixing element are defined between a peripheral fence of the trench and a peripheral wall of the casing, and the at least one fixing element is inserted into the at least one locking slot so as to fix the casing and the substrate;

wherein the substrate includes the trench formed in a central portion thereof, and the trench has a contacting face arranged on a bottom thereof and the peripheral fence surrounding an inner wall of the trench, wherein a profile of the contacting face corresponds to the casing, and a depth of the trench is equal to a thickness of the casing;

wherein the casing includes a bottom surface, a side surface, and a top surface, wherein when the casing is accommodated in the trench of the substrate, the bottom surface of the casing contacts with the contacting face of the trench, the side surface of the casing abuts against the peripheral fence of the trench, and the top surface of the casing flushes with a top of the substrate; and wherein a slit is defined between the side surface of the casing and the peripheral fence of the trench of the substrate, and the at least one locking slot is formed on two sides of the slit and accommodates the at least one fixing element.

2. The locking structure as claimed in claim 1, wherein a cross section of each of the at least one locking slot is circular, and a cross section of each of the at least one fixing element is a circular so that said each fixing element mates with said each locking slot.

3. The locking structure as claimed in claim 1, wherein a cross section of each of the at least one locking slot is rectangular, and a cross section of each of the at least one fixing element is a rectangular so that said each fixing element mates with said each locking slot.

4. The locking structure as claimed in claim 1, wherein a cross section of each of the at least one locking slot is triangular, and a cross section of each of the at least one fixing element is a triangular so that said each fixing element mates with said each locking slot.

5. The locking structure as claimed in claim 2, wherein the substrate is in a rectangle shape, the trench of the substrate and the casing are rectangular, and said each locking slot has a through orifice communicating with the substrate.

6. The locking structure as claimed in claim 3, wherein the substrate is in a rectangle shape, the trench of the substrate and the casing are rectangular, and said each locking slot has a through orifice communicating with the substrate.

7. The locking structure as claimed in claim 4, wherein the substrate is in a rectangle shape, the trench of the substrate and the casing are rectangular, and said each locking slot has a through orifice communicating with the substrate.

8. The locking structure as claimed in claim 5, wherein said each fixing element is a column so as to insert through the through orifice and to retain with said each locking slot.

9. The locking structure as claimed in claim 6, wherein said each fixing element is a column so as to insert through the through orifice and to retain with said each locking slot.

10. The locking structure as claimed in claim 7, wherein said each fixing element is a column so as to insert through the through orifice and to retain with said each locking slot.

11. The locking structure as claimed in claim 5, wherein said each fixing element is epoxy resin fed into said each locking slot so that the casing and the substrate are adhered together, after solidifying the epoxy resin.

12. The locking structure as claimed in claim 6, wherein said each fixing element is epoxy resin fed into said each locking slot so that the casing and the substrate are adhered together, after solidifying the epoxy resin.

13. The locking structure as claimed in claim 7, wherein said each fixing element is epoxy resin fed into said each locking slot so that the casing and the substrate are adhered together, after solidifying the epoxy resin.

14. The locking structure as claimed in claim 1, wherein the substrate is in a circle shape, the trench of the substrate and the casing are circular, at least one inlet is formed on the casing perpendicular to the at least one locking slot.

15. The locking structure as claimed in claim 14, wherein each of the at least one fixing element is epoxy resin fed into the at least one locking slot from each of the at least one inlet so that the casing and the substrate are adhered together, after solidifying the epoxy resin.

* * * * *